US010021946B2

(12) United States Patent
Kaneko

(10) Patent No.: US 10,021,946 B2
(45) Date of Patent: Jul. 17, 2018

(54) BUCKLE

(71) Applicant: YKK Corporation, Tokyo (JP)

(72) Inventor: Hitoshi Kaneko, Toyama (JP)

(73) Assignee: YKK Corporation (JP)

( * ) Notice: Subject to any disclaimer, the term of this patent is extended or adjusted under 35 U.S.C. 154(b) by 127 days.

(21) Appl. No.: 14/655,184

(22) PCT Filed: Dec. 25, 2012

(86) PCT No.: PCT/JP2012/083496
§ 371 (c)(1),
(2) Date: Jun. 24, 2015

(87) PCT Pub. No.: WO2014/102905
PCT Pub. Date: Jul. 3, 2014

(65) Prior Publication Data

US 2015/0327631 A1 Nov. 19, 2015

(51) Int. Cl.
*A44B 11/26* (2006.01)
*A44B 11/25* (2006.01)

(52) U.S. Cl.
CPC ..... *A44B 11/263* (2013.01); *A44B 11/258* (2013.01); *A44B 11/266* (2013.01); *Y10T 24/45791* (2015.01)

(58) Field of Classification Search
CPC ... A44B 11/263; A44B 11/258; A44B 11/266; Y10T 24/45791
See application file for complete search history.

(56) References Cited

U.S. PATENT DOCUMENTS 1,242,159 A * 10/1917 Dunkleberger .... A44B 17/0011 24/665
1,271,650 A * 7/1918 Arkin ..... A44B 11/266 24/657

(Continued)

FOREIGN PATENT DOCUMENTS

JP 16-18791 Y1 12/1941
JP 9-47306 A 2/1997

(Continued)

OTHER PUBLICATIONS

International Search Report, PCT Application No. PCT/JP2012/083496, dated Apr. 16, 2013.

*Primary Examiner* — Robert Sandy
*Assistant Examiner* — Louis A Mercado
(74) *Attorney, Agent, or Firm* — Kilpatrick Townsend & Stockton LLP

(57) ABSTRACT

A buckle includes a male member and a female member. The male member is provided with an engagement section which protrudes from a body section. The female member includes a pressing elastic member which is provided with an engagement receiving section with which the engagement section engages; and a housing body in which a housing space for housing the pressing elastic member is housed. The housing body has an opening which connects to the housing space and into which the engagement section is inserted. The pressing elastic member is integrally provided with: a pair of pressing sections-which protrudes from the housing space of the housing body; elastic body sections which connect the pair of pressing sections together, elastically support the pressing sections, and enable the pressing sections to elastically move into the housing section; and the engagement receiving section which is supported by the elastic body sections.

8 Claims, 14 Drawing Sheets

(56) References Cited

U.S. PATENT DOCUMENTS

| | | | | |
|---|---|---|---|---|
| 1,380,177 | A | 5/1921 | Arkin | |
| 1,402,827 | A * | 1/1922 | Arkin | A44B 17/0011 24/110 |
| 2,364,266 | A * | 12/1944 | Allan | A44B 1/34 24/356 |
| 4,713,865 | A * | 12/1987 | Geldwerth | A44B 11/266 24/615 |
| 7,007,353 | B2 * | 3/2006 | Bergkvist | A44B 11/266 24/640 |
| 7,624,484 | B2 * | 12/2009 | Lundh | A44B 11/258 24/607 |
| 8,464,407 | B2 * | 6/2013 | Von Der Ahe | A44B 11/2519 24/634 |
| 2005/0071962 | A1 | 4/2005 | Bergkvist | |
| 2010/0037437 | A1 * | 2/2010 | Buday | A44B 11/266 24/163 K |
| 2016/0037879 | A1 * | 2/2016 | Qian | A44B 11/258 24/3.2 |
| 2016/0051013 | A1 * | 2/2016 | Mitchell, Jr. | A63B 71/10 24/163 R |
| 2016/0150857 | A1 * | 6/2016 | Botkus | A44B 11/2592 24/615 |

FOREIGN PATENT DOCUMENTS

| | | | |
|---|---|---|---|
| JP | 2004-530521 | A | 10/2004 |
| WO | 2003/003869 | A1 | 1/2003 |

* cited by examiner

BUCKLE

This application is a national stage application of PCT/JP2012/083496, which is incorporated herein by reference.

TECHNICAL FIELD

The present invention relates to a buckle having a male member and a female member capable of being engaged with and disengaged from each other.

BACKGROUND ART

Conventionally, as buckles for detachably connecting two connecting objects together, for example, as disclosed in Patent Document 1, a buckle is known which is constituted of a first buckle member as a male member attached to one connecting object and having an columnar-shaped engaged portion and a second buckle member as a female member attached to the other connecting object and having a latching device in which the engaged portion of the first buckle member is inserted and locked. The latching device is configured so that the first buckle member can be vertically locked with respect to a relative flat surface of the second buckle member and also the second buckle member locked on the first buckle member is detachably connected thereto to be relatively rotated about the engaged portion of the first buckle member. The configuration of the latching device includes pressing portions exposed on the outside of a ring-shaped main body of the second buckle member, an engaging portion to be engaged with the engaged portion, and connection members having an elastic portion for elastically supporting the engaging portion. The connection members are provided in one pair and these two connection members are urged toward each other by the elastic portion so that each engaging portion can be engaged with the engaged portion of the first buckle member. Also, when each pressing portion is pressed, each engaging portion is separated from the engaged portion of the first buckle member, thereby allowing disconnection.

PRIOR ART DOCUMENT

Patent Document

Patent Document 1: Japanese Patent Application Publication No. 2004-530521A (WO2003/003869)

SUMMARY OF INVENTION

Problems to Be Solved by Invention

The buckle described in Patent Document 1, the latching device attached to the second buckle member is constituted of two-piece connection members each having the pressing portion, the elastic portion and the like, thereby increasing the number of components. Accordingly, there is a problem in that management of components is complicated and also assembly man-hours are increased.

The present invention has been made keeping in mind problems of the background art as described above, and an object thereof is to provide a buckle in which the number of components can be reduced, assembly man-hours can be decreased and also a good operability can be provided.

Means for Solving Problems

The present invention is a buckle including a male member and a female member capable of being connected to and disconnected from each other, each provided with an attaching portion to be attached to another member, wherein the male member is formed with an engaged portion protruding from a main body portion which is provided with the attaching portion, wherein the female member is formed with a pressing elastic member provided with an engaging portion which is configured to be engaged with the engaged portion, and a receiving main body formed with a receiving space for receiving the pressing elastic member, wherein the receiving main body is formed with an opening portion communicated with the receiving space and configured to insert the engaged portion therethrough, and wherein the pressing elastic member is integrally provided with: a pair of pressing portions protruding from the receiving space of the receiving main body; an elastic body portion connecting the pair of pressing portions together and elastically supporting the pressing portions to allow the pressing portions to be elastically moved into the receiving main body; and the engaging portion elastically held on the elastic body portion.

The engaging portion is provided so as to be movable in a direction intersecting with a pressing direction of the pair of pressing portions by pressing the pressing portions.

In addition, the pair of pressing portions are formed on both end portions of the pressing elastic member, the engaging portions are symmetrically provided between the pressing portions so that the engaging portions are positioned so as to sandwich the engaged portion therebetween in a connected state, and each of a pair of the engaging portions is connected with a pair of the elastic body portions between the pair of pressing portions.

The engaged portion is formed in a columnar shape and forms a stepped portion by a shaft portion formed on a middle thereof along a protruding direction and having a relatively small diameter and a leading end portion having a relatively large diameter.

Also, the pressing portions of the pressing elastic member are formed with a pair of locking claw pieces extending from one of the pressing portions toward the other of the pressing portions, leading end portions of the locking claw pieces are provided with claw portions protruding toward inner surfaces of side walls of the receiving space, and positioning portions with which the claw portions are engaged are provided on inner walls of the receiving space of the receiving main body.

The engaging portion of the pressing elastic member has a locking protrusion portion, an inner surface of a side wall of the receiving space of the female member has a locking recess portion, and when pressing operation of the pressing members is performed, the locking protrusion portion which moves in the direction intersecting with the pressing direction and the locking recess portion are engaged with each other.

A projection is provided on one surface of the pressing elastic member facing a wall surface of the receiving space, and a groove portion in which the projection is slid therein is formed on one wall surface of the receiving space.

The engaged portion of the male member is provided with a protrusion at a position thereon to be engaged with the engaging portion, and the engaging portion of the pressing elastic member is formed with a recess against which the protrusion abuts.

At least one of the attaching portions provided on the male member and the female member is a band body attaching hole to which a band body can be attached.

Advantageous Effects of Invention

According to the buckle of the present invention, the engaging portion to be engaged with the engaged portion provided on the male member can be constructed by a single pressing elastic member formed in a flat plate shape, thereby reducing the number of components of the entire device and also facilitating assembling thereof.

EMBODIMENTS OF INVENTION

Figure 1:
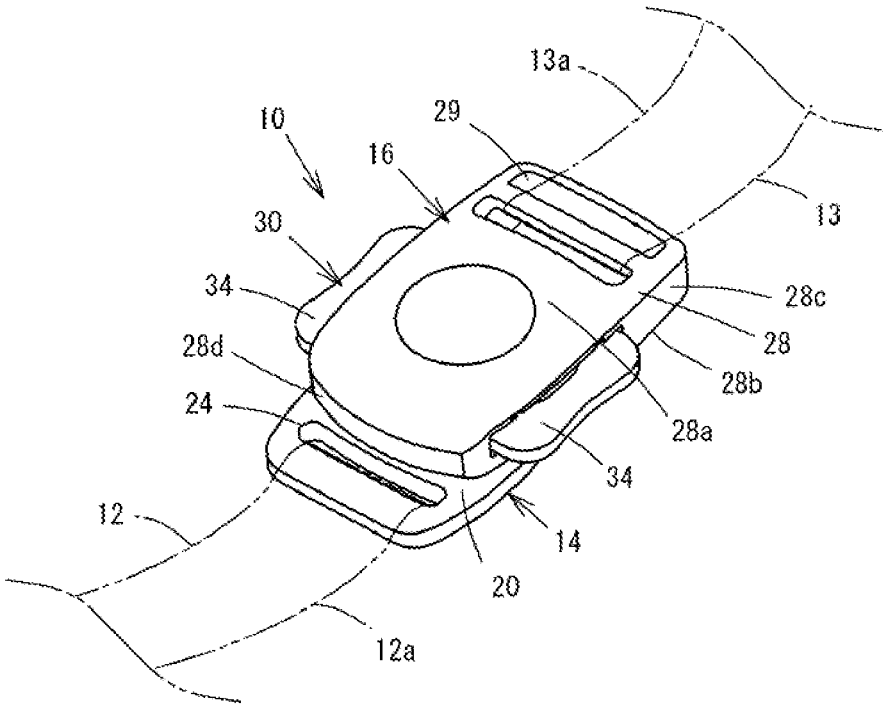
FIG. 1 is a perspective view showing a usage state of a buckle according to a first embodiment of the present invention.

Now, a buckle 10 according to a first embodiment of the present invention will be described with reference to FIGS. 1 to 9. The buckle 10 of the first embodiment is intended to detachably connect together end portions 12*a* and 13*a* of two band bodies 12 and 13, each of which is a belt or sling of a child seat, a shoulder belt of a backpack, or one of any other members to be connected together, and is constituted of a male member 14 and a female member 16 configured to allow the male member 14 to be fitted and locked therein. The female member 16 is constituted of a receiving main body 28 and a pressing elastic member 30. Meanwhile, in the following description, a direction in which a pair of pressing portions 34 of the pressing elastic member 30 as described below face each other and also move close to and apart from each other is referred to as a right and left direction, a longitudinal direction of side edge portions of the pressing portions 34 of the pressing elastic member 30 as a direction perpendicular to the right and left direction is referred to as a forward and rearward direction, and a direction perpendicular to the right and left direction and the forward and rearward direction is referred to as a front and back direction.

Figure 2:
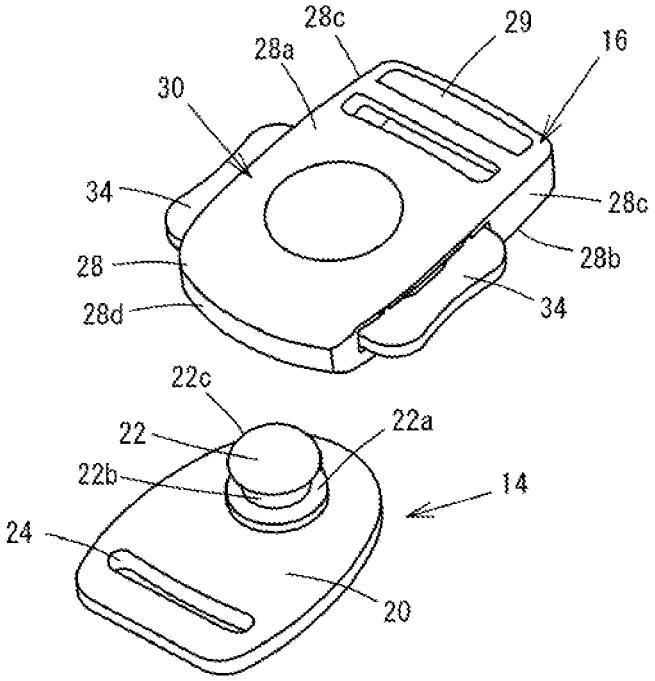
FIG. 2 is a perspective view showing a state where a male member and a female member of the buckle of the first embodiment are separated from each other.
Figure 7A:
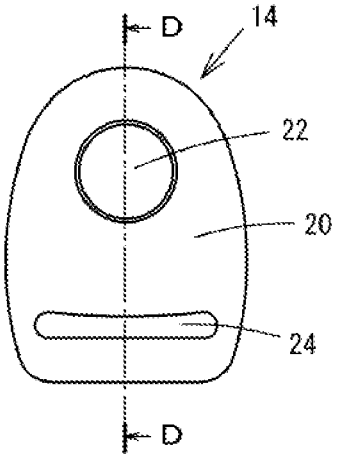
FIG. 7A is a front view of the male member of the buckle of the first embodiment and FIG. 7B is a sectional view thereof taken along a line D-D.
Figure 7B:
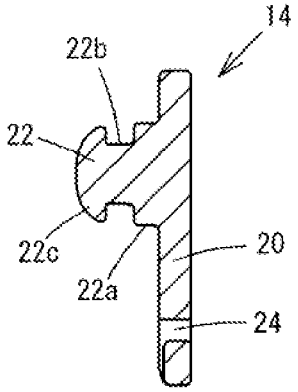

As shown in FIGS. 2, 7 and the like, the male member 14 has a plate-shaped main body portion 20, one engaged portion 22 integrally protruding from the middle portion of one end-side surface of the main body portion 20 in a direction orthogonal to a plate plane thereof, and a band body attaching hole 24 formed on the other end side thereof. The band body attaching hole 24 is an attaching portion for attaching one band body 12 to the male member 14 by passing the end portion 12*a* of the band body 12 therethrough. The attaching portion may be any attaching portions, to which any other members, such as a belt of a child seat or a shoulder belt of a backpack, can be attached, other than the band body attaching hole 24.

The engaged portion 22 of the male member 14 is formed in a circular columnar shape and is formed by a base end portion 22*a* formed in a circular disc shape on the surface of the main body portion 20, and a shaft portion 22*b* formed to have a diameter smaller than that of the base end portion 22*a*, and a half sphere-shaped leading end portion 22*c* having a diameter larger than that of the shaft portion 22*b*. Due to a difference between diameters of the shaft portion 22*b* and the leading end portions 22*c*, a stepped portion against which engaging portions 40 as described below are to be abutted and held is provided. The male member 14 is formed by integral molding using a synthetic resin, such as polyacetal, polyamide or polypropylene.

The female member 16 is constituted of a generally rectangular receiving main body 28 having a receiving space 26, which is a relatively flat space, defined therein, and an elastic pressing member 30 inserted into the receiving space 26 of the receiving main body 28 and formed in a plate shape. Each of the receiving main body 28 and the pressing elastic member 30 of the female member 16 is also formed by integral molding using a synthetic resin, such as polyacetal, polyamide or polypropylene. Meanwhile, in the following description, a thickness of the female member 16 is a dimension in a direction parallel to a direction along which the male member 14 is fitted into the female member 16, and a thickness direction thereof corresponds to a direction in which the engaged portion 22 of the male member 14 protrudes from the main body portion. Also, the thickness direction corresponds to the front and back direction of the pressing elastic member 30.

Figure 3A:
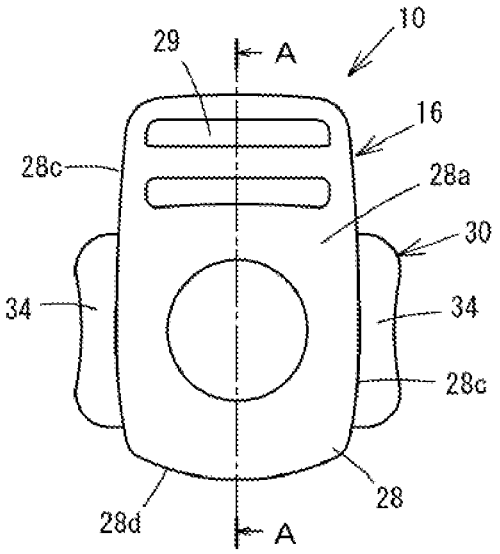
FIG. 3A is a front view of the buckle of the first embodiment and FIG. 3B is a sectional view thereof taken along a line A-A.
Figure 3B:
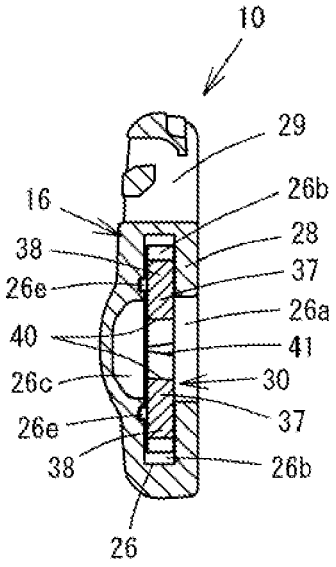
Figure 5A:
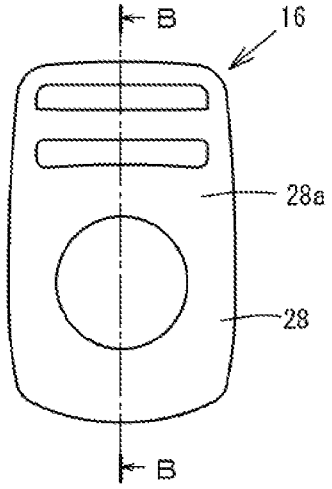
FIG. 5A is a front view of the female member of the buckle of the first embodiment and FIG. 5B is a sectional view thereof taken along a line B-B.
Figure 5B:
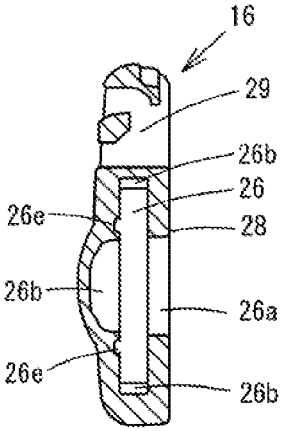

As shown in FIGS. 3, 5 and the like, the receiving main body 28 is formed in a rectangular parallelepiped shape by a front portion 28*a* and a back portion 28*b*, which are formed to be flat and also to be spaced from each other in the front and back direction, a pair of side portions 28*c* connecting together end portions of the front and back portions on both right and left sides and a wall portion 28*d*, and within a thickness of the rectangular parallelepiped shape in the front and back direction, the receiving space 26 is formed to extend through between the pair of side portions 28*c* on right and left sides. The back surface 28*b* of the receiving main body 28 has an opening portion 26*a* formed to allow the engaged portion 22 of the male member 14 to be inserted therethrough and also to be communicated with the receiving space 26. On an inner wall surface of the middle portion of the receiving space 26 located toward the front portion 28*a*, a leading end receiving portion 26*c* is formed to allow the leading end portion 22*c* of the engaged portion 22 of the male member 14 to be inserted therein. Alternatively, the leading end receiving portion 26*c* may be configured not to be covered with a wall surface of the front portion 28*a* of the receiving main body 28 or a penetration may be formed to extend from the leading end receiving portion 26*c* to the front portion 28*a* of the receiving main body 28. The opening portion 26*a* is formed in a circular shape and a diameter thereof is slightly larger than diameters of the leading end portion 22*c* and the base end portion 22*a* of the engaged portion 22. In addition, on inner surfaces of side walls of the receiving space 26, which face each other in a direction perpendicular to the pair of side portions 28*c*, locking recess portions 26*b* are respectively formed to allow locking protrusion portions 38 of the pressing elastic member 30 to be fitted therein. Positioning portions 26*d* allowing claw portions 42*a* of the pressing elastic member 30, as described below, to be engaged therewith are respectively formed at four positions in the vicinity of the middles between both side portions 28*c* and the locking recess portions 26*b* on inner surfaces of side walls of the receiving space 26, on which the locking recess portions 26*b* are formed. Each positioning portion 26*d* is formed to be stepped so that a dimension of a part thereof, which is located toward the locking recess portion 26*b*, in a forward and rearward direction of the receiving space 26 is smaller than a dimension of a part thereof, which is located toward the side portion 28*c*, in the forward and rearward direction. In inner wall surfaces of the receiving space 26 of the receiving main body 28 located on both sides of the leading end receiving portion 26*c*, a pair of groove portions 26*e* penetrating between the side portions 28*c* are formed in parallel to extend along the right and left direction. Band body attaching hole 29, which are an attaching portion, are provided on an end portion of the receiving main body 28 located on one side from the front surface middle portion thereof. The band body attaching holes 29 are provided in parallel in two rows along the right and left direction perpendicular to the side portions 28*c* and are the attaching portion for the other band body 13 configured to allow the end portion 13*a* of the band body 13 to be inserted therein and to allow a length of the band body 13 to be adjusted. This attaching portion may be any attaching portions, to which any other members, such as a belt of a child seat or a shoulder belt of a backpack, can be attached, other than the band body attaching holes 29.

Figure 4:
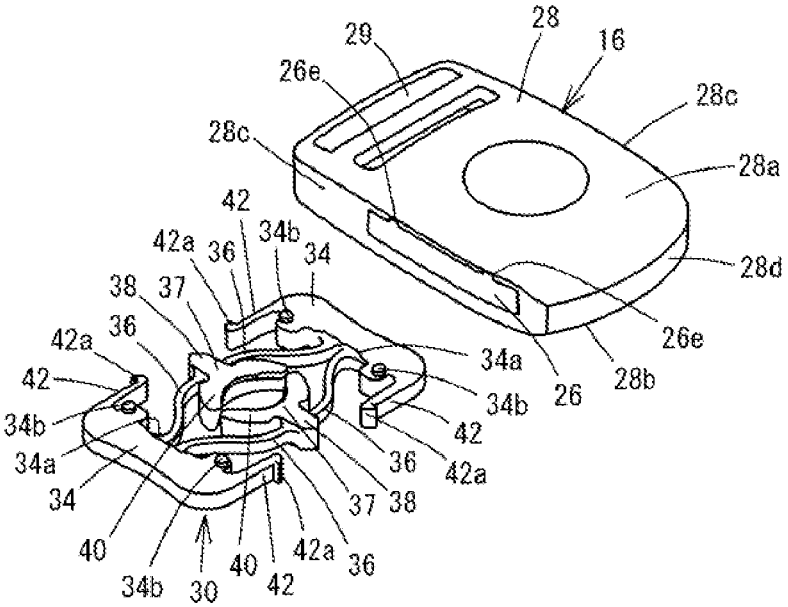
FIG. 4 is an exploded perspective view of the female member of the buckle of the first embodiment.
Figure 6A:
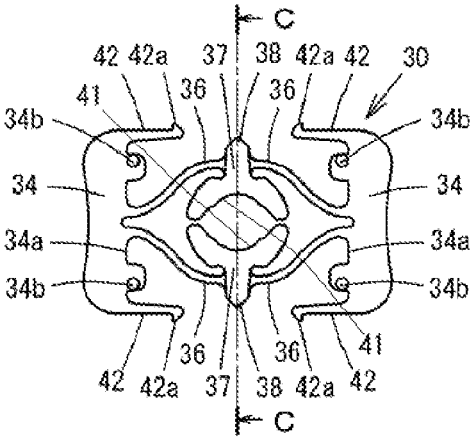
FIG. 6A is a front view of an elastic member of the buckle of the first embodiment and FIG. 6B is a sectional view thereof taken along a line C-C.
Figure 6B:
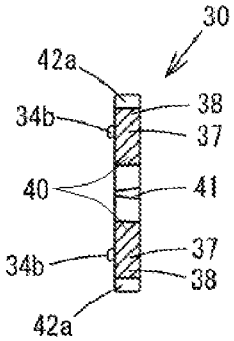

As shown in FIGS. 4, 6 and the like, the pressing elastic member 30 to be inserted into the receiving space 26 is integrally formed in a plate shape within a predetermined thickness, and a pair of opposing side end portions thereof are provided as the pair of pressing portions 34. Namely, the pressing elastic member 30 is dimensioned to be slidable in the receiving space 26. On each of facing inner side surfaces 34*a* of the pressing portions 34, a pair of elastic body portions 36 are respectively integrally formed to be symmetrically curved in a generally smooth S-shape relative to the middle portion thereof and also to extend to be symmetrically widened in the forward and rearward direction as they go the middle portion toward the other pressing portion 34.

The elastic body portions 36 are formed in a plate shape and a dimension thereof in the thickness direction of the pressing elastic member 30 is larger than a plate thickness of the elastic body portions 36 in a direction perpendicular to the thickness direction. Thus, the elastic body portions 36 are configured to relatively easily bend and thus be elastically deformable in a direction parallel to front and rear surfaces of the pressing elastic member 30 within a range of the thickness of the pressing elastic member 30. Meanwhile, a bending direction of the elastic body portions 36 can be appropriately set by changing a cross-section shape or an entire shape thereof, and also a moving direction of the engaging portions 40, as described below, can be appropriately set to a direction oblique to a pressing direction of the pressing portions 34 or the like. In addition, the pair of elastic body portions 36 extending from the middle portion of the pressing portions 34 are connected to connection bodies 37 located in the vicinity of the middle portion between the pressing portions 34. The connection bodies 37 are provided in one pair at positions which are symmetric to each other and also each connection body 37 is held by two elastic body portions 36 extending from the pressing portions 34 facing each other. Thus, moving of the connection bodies 37 in accordance with pressing of the pressing portions 34 may be sufficient so long as a direction thereof is set to intersect with the pressing direction, and accordingly, other than the curved shape, the elastic body portions 36 may be provided in a linear shape oblique to the pressing direction or a combined shape of a curved portion and a linear portion.

The connection bodies 37 includes locking protrusion portions 38 each having a leading end protruding in the forward and rearward direction, which is a direction perpendicular to the facing direction of the pressing portions 34, and are fitted into the locking recess portions 26*b*, which are formed in the inner surfaces of the side walls of the receiving space 26, in a disengaged state of the engaged portion 22 and the engaging portion 40. When the pressing portions 34 of the pressing elastic member 30 are pressed, even if pressing forces on right and left sides are not identical and thus one pressing portion 34 is strongly pressed as compared to the other, the locking protrusion portions 38 can be fitted into the locking recess portions 26*b* so that a pair of locking protrusion portions 38 are guided in the forward and rearward direction along the center in the right and left direction by a pair of locking recess portions 26*b*. Accordingly, a pair of engaging portions 40 are exactly disengaged from the leading end portion 22*c* of the engaged portion 22. The locking protrusion portions 38 are provided in one pair at positions which are symmetric to each other.

The connection bodies 37 are respectively integrally provided with crescent moon-shaped engaging portions 40 having the same shape and respectively including recess portions, which are curved in directions opposite to the protruding directions of the locking protrusion portions 38 and face each other. The pair of engaging portions 40 face each other so that the curved recess portions thereof face each other, and a gap therebetween can be narrowed or widened by the elastic body portions 36. The maximum gap between the curved inlet portions of the engaging portions 40 is smaller than the diameter of the leading end portion 22*c* of the engaged portion 22 of the male portion 14 and larger than the diameter of the shaft portion 22*b*. Engaging surfaces 41 of the pair of engaging portions 40, which face each other, are formed in an inclined surface shape to be widened toward the opening portion 26*a* of the receiving space 26, thereby facilitating operations of inserting and engaging the engaged portion 22 therein can be facilitated but being difficult for the engaged portion 22 to be pulled out therefrom. In addition, the engaging portions 40 are elastically held on the elastic body portions 36 via the connection bodies 37. Accordingly, the engaging portions 40 are integrally moved together the connection bodies 37 in accordance with an elastic deformation of the elastic body portions 36.

On a front side of each pressing portion 34, a pair of projections 34*b* are integrally formed to be fitted into the groove portions 26*e* of the receiving space 26. On both end portions, in the forward and rearward direction, of each of the facing pressing portions 34, a pair of locking claw pieces 42 are formed to extend toward the opposite pressing portion 34. On leading end portions of the locking claw pieces 42, claw portions 42*a* are provided to protrude toward the inner surfaces of the side walls of the receiving space 26.

Figure 8A:
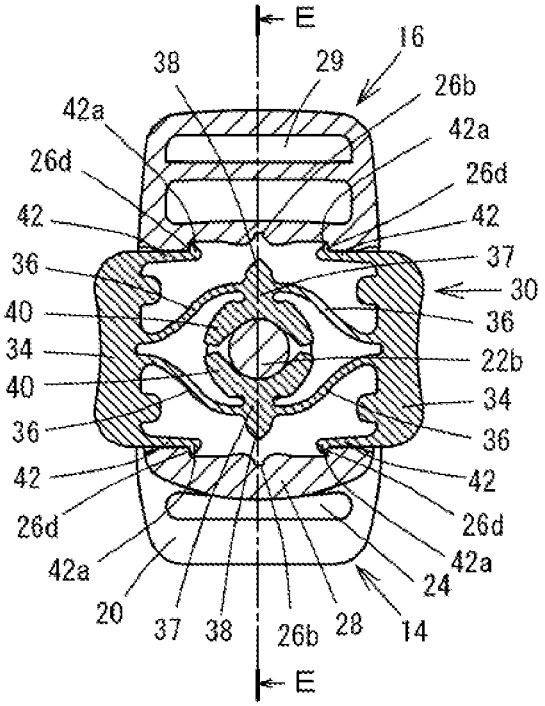
FIG. 8A is a sectional view showing a state where the male member and the female member of the buckle of the first embodiment are engaged with each other, taken along a plane parallel to a paper surface of the front view thereof.
Figure 8B:
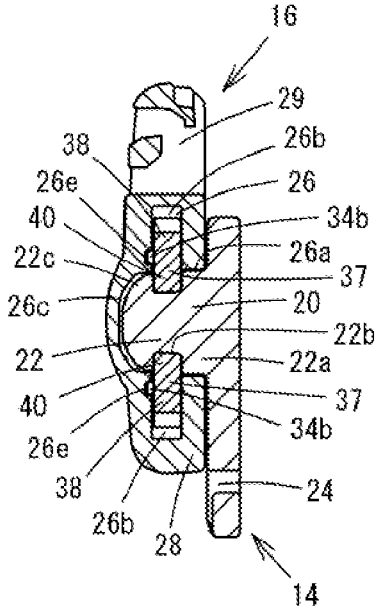
FIG. 8B is a sectional view thereof taken along a line E-E.

As shown in FIGS. 4 and 8, assembling of the buckle 10 according to the present embodiment is performed by inserting one pressing portion 34 of the pressing elastic member 30 into the receiving space 26 of the receiving main body 28 and then locking the claw portions 42*a* of two pairs of locking claw pieces 42 on the positioning portions 26*d*, which are formed by the stepped portion located at four positions in the receiving space 26. At this time, the projections 34*b* on the front side of the pressing elastic member 30 are fitted and slidingly inserted into the groove portions 26*e* of the receiving space 26 of the receiving main body 28. Thus, the pressing elastic member 30 can be easily inserted into the receiving space 26, and if the pressing elastic member 30 has front and back sides, distinction between front and back sides is also possible. In this state, the pair of engaging portions 40 are positioned in the receiving space 26 to face the opening portion 26*a* on the back side of the receiving main body 28.

A connecting operation of the buckle 10 according to the present embodiment is performed by inserting the engaged portion 22 of the male member 14 into the opening portion 26*a* on the back side of the female member 16 while facing the opening portion 26*a* and then inserting the leading end portion 22*c* between the pair of engaging portions 40. At this time, the leading end portion 22*c* having a generally half-sphere shape passes between the engaging portions 40 by pushing aside the pair of engaging portions 40 in the forward and rearward direction, elastically deforming the elastic body portions 36 to be bent, and thus widening the gap between the pair of engaging portions 40. Then, the pair of engaging portions 40 are positioned on the shaft portion 22*b* of the engaging portion 22 and bending of the elastic body portion 36 are elastically returned so that the engaging portions 40 are returned to the original positions. In this state, the pair of engaging portions 40 are locked on the leading end portion 22*c* of the engaged portion 22, thereby preventing the engaged portion 22 from being pulled out in an axial direction thereof (front and back direction). In addition, the pair of engaging portions 40 and the engaged portion 22 are also engaged with each other in directions (right and left direction and forward and rearward direction) perpendicular to the axial direction of the engaged portion 22. Further, the base end portion 22*a* of the engaged portion 22 is fitted in the opening portion 26*a* of the receiving main body 28 with a small clearance interposed therebetween and also the leading end portion 22*c* is fitted in the leading end receiving portion 26*c* of the receiving main body 28 with a small clearance interposed therebetween. Thus, the male member 14 and the female member 16 are kept positioned and connected to each other and thus are prevented from being disconnected. However, in this state, relatively about the axis of the engaged portion 22, the base end portion 22*a* of the engaged portion 22 can be pivoted in the opening portion 26*a* of the receiving main body 28, the shaft portion 22*b* can be freely pivoted between the pair of engaging portions 40 and also the leading end portion 22*c* can be pivoted in the leading end receiving portion 26*c*.

Figure 9A:
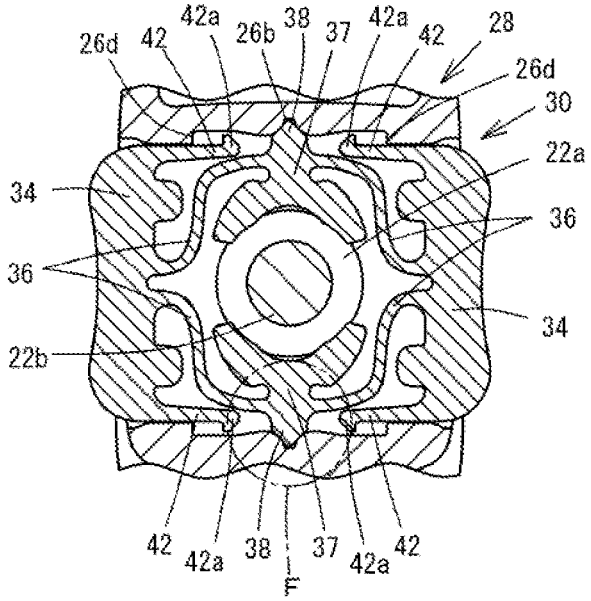
FIG. 9A is a partial sectional view upon disengaging from the state of FIG. 8A.
Figure 9B:
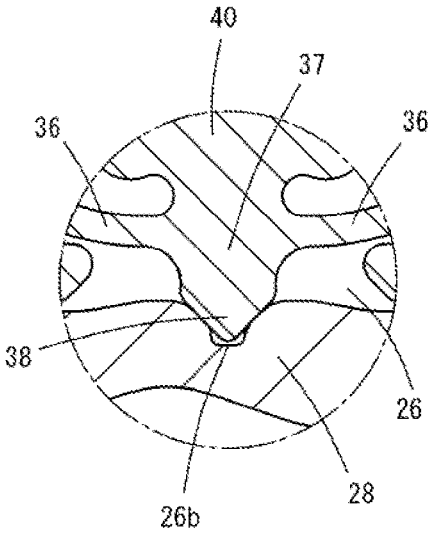
FIG. 9B is an enlarged sectional view of a section F.

Then, in order to disconnect the male member 14 from the female member 16, the pressing portions 34 of the pressing elastic member 30 are pressed to approach to each other, thereby pushing the pressing portions 34 into the receiving space 26 of the receiving main body 28. Thus, the curved portions of the elastic body portions 36 are elastically bent and as shown in FIG. 9, are moved in the forward and rearward direction perpendicular to the pressing direction of the pair of engaging portions 40 and the axial direction of the engaged portion 22. In this state, the gap between the pair of engaging portions 40 is wider than the diameter of the leading end portion 22*c* of the engaged portion 22, and thus the male member 14 and the female member 16 can be disconnected from each other by separating the female member 16 from the male member 14 in the axial direction of the engaged portion 22 thereof. At this time, the locking protrusion portions 38 of the pressing elastic member 30, as shown in FIG. 9, are moved in the forward and rear direction by pressing the pressing portions 34 and thus are guided and fitted by inner surfaces of the locking recess portions 26*b* in the receiving space 26 of the receiving main body 28. In addition, as the pressing portions 34 are pressed, the locking protrusion portions 38 are fitted to and positioned in the insides of the locking recess portions 26*b*. Thus, the engaging portions 40 are exactly and stably maintained at the middle position between the pressing portions 34 and also are reliably kept separated from the engaged portion 22 of the male member 14. Then, the male member 14 is disconnected from the female member 16 by separating the male member 14 from the female member 16 in a direction opposite to the protruding direction of the engaged portion 22.

According to the buckle 10 of the present embodiment, the pressing elastic member 30 can be formed by integral molding using resin and can be shaped to be thinner than that of the case where two pressing elastic members are formed as separate bodies as in the buckle described in the background art, and also a thickness of the female member 16 in which the pressing elastic member 30 are received can become thinner. In addition, the pressing elastic member 30 has an integral structure and includes the pair of pressing portions 34 and the pair of engaging portions 40, thereby providing a good operability, and reduction the number of components, and also facilitating managements of components or assembly procedures. The elastic body portions 36 of the pressing elastic member 30 are symmetrically arranged in two pairs and are evenly bent by pressing the pressing portions 34 so that the engaged portion 22 and the engaging portions 40 are disengaged from each other and also the locking protrusion portions 38 are fitted and positioned in the locking recess portions 26*b* of the receiving main body 28. Accordingly, such a disengaging operation can be stably performed and thus a disconnecting operation of the male member 14 and the female member 16 can be reliably performed.

Next, a second embodiment of a buckle according to the preset invention will be described with reference to FIGS. 10 to 12. Herein, the same members as those of the foregoing embodiment are designated by the same reference numerals, and the descriptions thereof will be omitted. The buckle 50 of the present embodiment is configured so that a resistance is imparted on a shaft portion 22*b* of an engaged portion 22 of a male portion 14 during pivoting operation of the male member 14 and a female member 16 relative to each other and thus positions thereof can be temporarily kept. As the resistance for keeping the positions, the shaft portion 22*b* of the engaged portion 22 is provided with protrusions 22*d* formed to protrude from the shaft portion 22*b* at intervals of 90° and extend in the front and back direction, and also engaging portions 40 are provided with a plurality of recesses 40*a* formed to allow the protrusions 22*d* to be climbed over and fitted therein. Alternatively, although in this example, three recesses 40*a* are formed on each engaging portion 40, one recess 40*a* may be formed on each engaging portion 40. Also, the protrusions 22*d* and the recesses 40*a* are preferably formed as in the present embodiment, but may be inversely formed on the shaft portion 22*b* of the engaged portion 22 and the engaging portion 30.

Figure 10A:
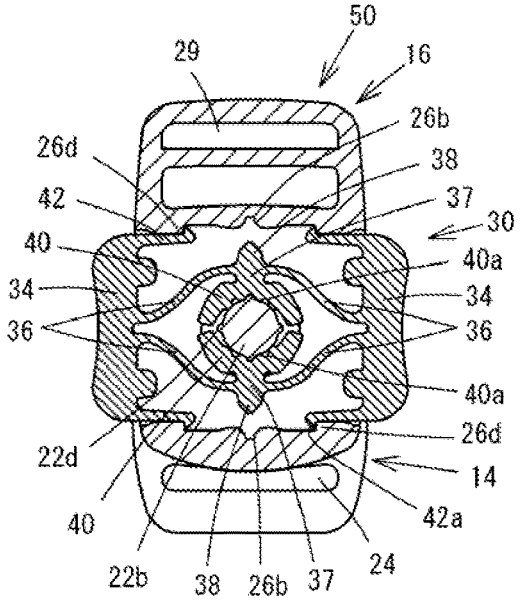
FIG. 10A is a sectional view showing a state where a male member and a female member of a buckle of a second embodiment of the invention are engaged with each other, taken along a plane parallel to a paper surface of the front view thereof.
Figure 10B:
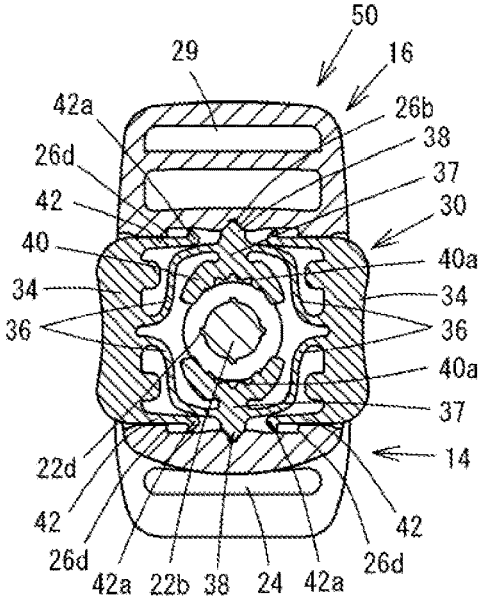
FIG. 10B is a sectional view of a disengaged state thereof.
Figure 11A:
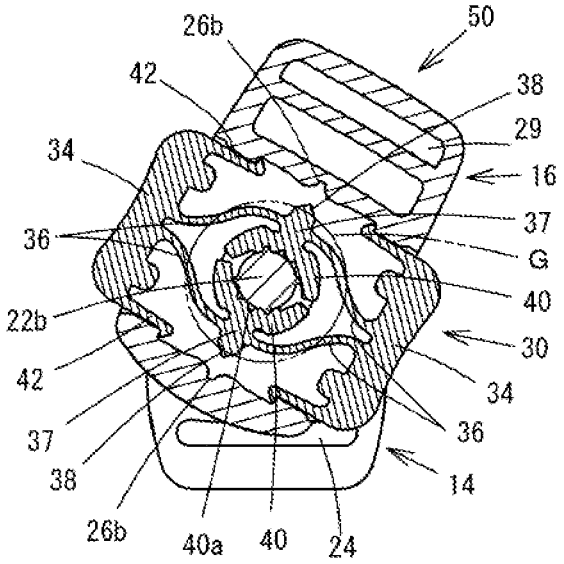
FIG. 11A is a sectional view of a state where the female member is pivoted from the state of FIG. 10A.
Figure 11B:
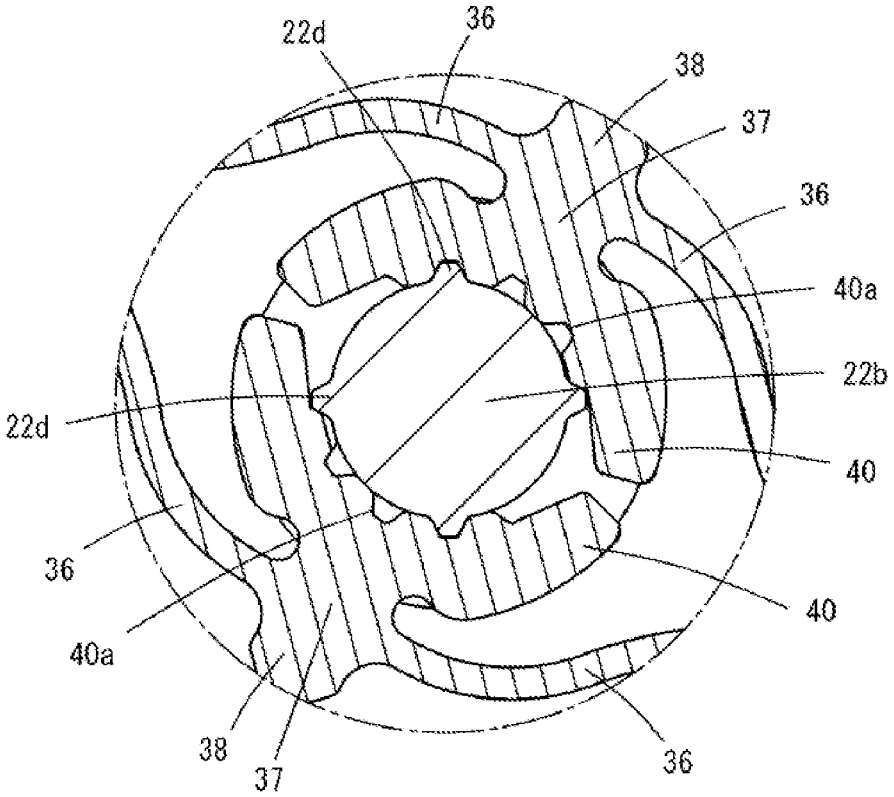
FIG. 11B is an enlarged sectional view of a section G.
Figure 12A:
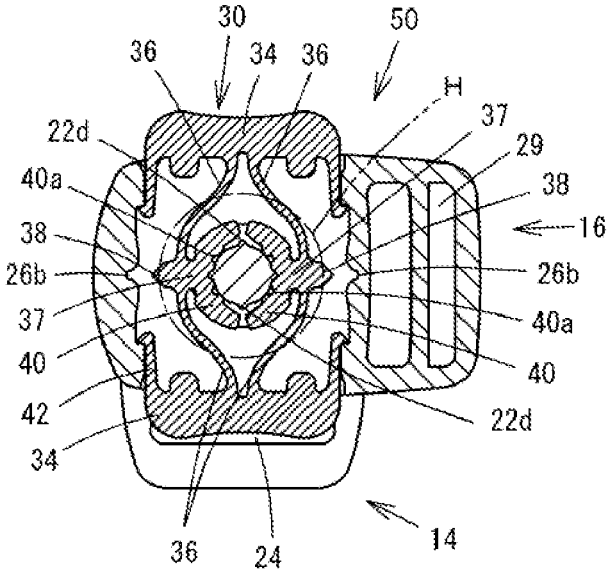
FIG. 12A is a sectional view of a state where the female member is pivoted by 90° relative to the male member from the state of FIG. 10A.
Figure 12B:
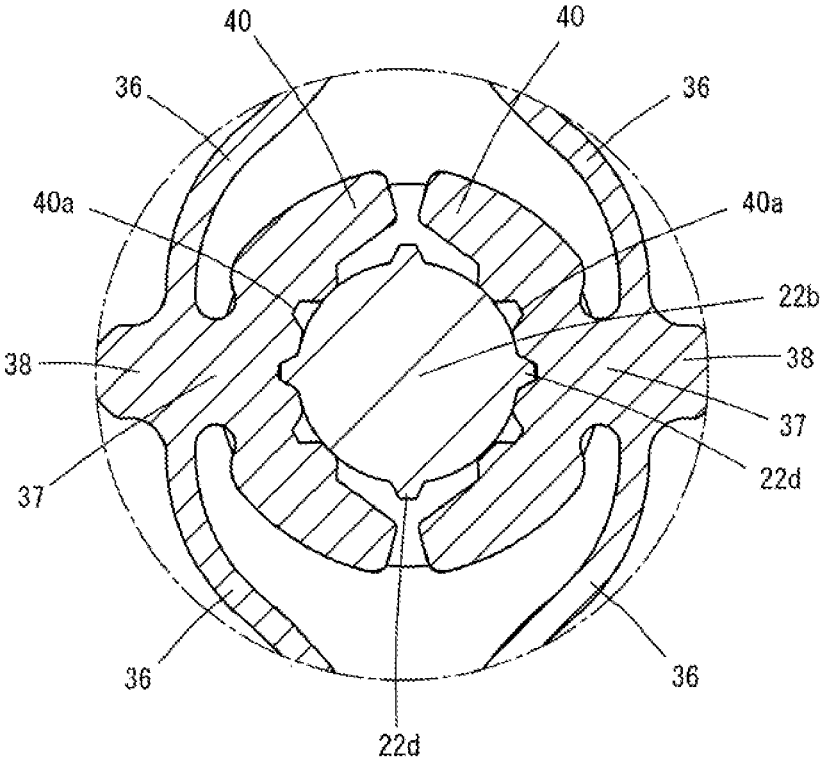
FIG. 12B is an enlarged sectional view of a section H.

Operations and usage of the buckle 50 according to the present embodiment are the same as the foregoing embodiment, and in addition, a relative angle between the male member 14 and the female member 16 can be kept at positions pivoted from an aspect shown in FIG. 10, to states shown in FIGS. 11 and 12. A force for keeping the positions corresponds to a resistance force, against which the recesses 40*a* of the engaging portions 40 deform the protrusions 22*d* of the engaged portion 22 when being climbed over the protrusions 22*d*, and thus serves as a holding force for positioning. Meanwhile, because the recesses 40*a* are climbed over the protrusions 22*d*, the recesses 40*a* and the protrusions 22*d* are preferably provided with inclines surfaces in a circumferential direction of the shaft portion 22*b*.

According to the buckle 50 of the present embodiment, configurations of the pressing elastic member 30 can be formed by a single member like the foregoing embodiment, thereby providing a buckle having the reduced number of components and a good operability, and in addition, a stepwise positioning function can be imparted to a pivoting operation of the male member 14 and the female member 16.

Next, a third embodiment of a buckle according to the preset invention will be described with reference to FIG. 13. Herein, the same members as those of the foregoing embodiments are designated by the same reference numerals, and the descriptions thereof will be omitted. The buckle 52 of the present embodiment is configured so that a shaft portion 22*b* of an engaged portion 22 of a male portion 14 is formed to have a star-shaped cross section and like the forgoing embodiment, a resistance is imparted thereon during pivoting operation of the male member 14 and a female member 16 relative to each other. Herein, as the resistance for keeping positions, the shaft portion 22*b* of the engaged portion 22 has eight triangular protrusions 22*e* on a side surface thereof and thus has a star-shaped cross section, and engaging portions 40 are provided with a plurality of recesses 40*b* formed to be respectively fitted with the star-shaped protrusions 22*e*. Alternatively, four protrusions 22*e* may be formed at intervals of 90°, and also one recess 40*b* may be provided on each engaging portion 40.

Figure 13A:
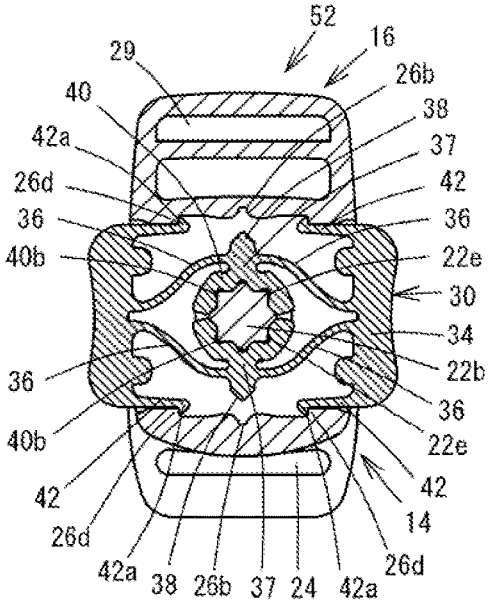
FIG. 13A is a sectional view showing a state where a male member and a female member of a buckle of a third embodiment of the invention are engaged with each other, taken along a plane parallel to a paper surface of the front view thereof.
Figure 13B:
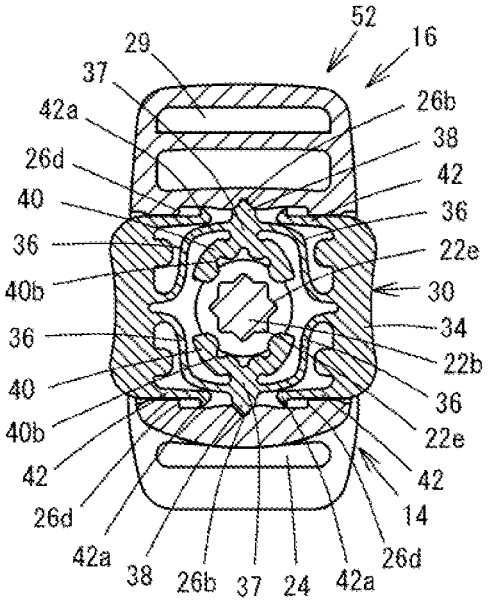
FIG. 13B is a sectional view of a disengaged state.
Figure 13C:
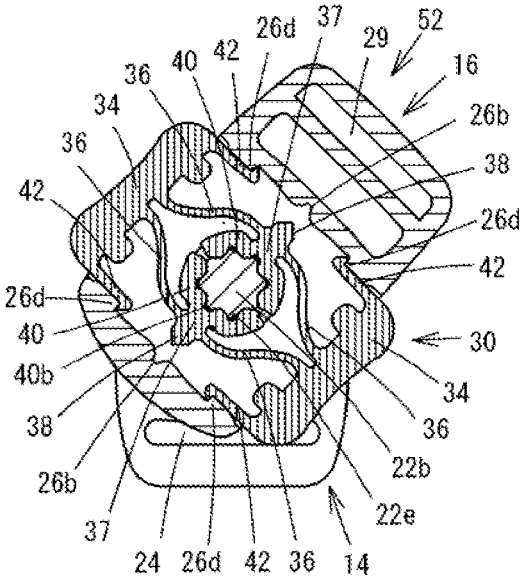
FIG. 13C is a sectional view of a state where the female member is pivoted relative to the male member from the state of FIG. 13A.
Figure 13D:
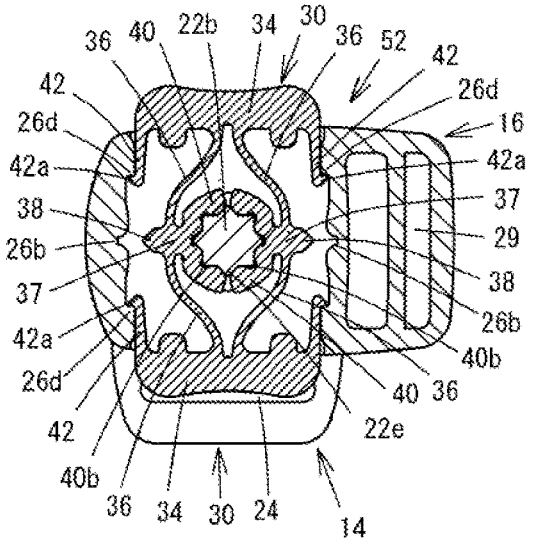
FIG. 13D is a section view of a state where the female member is pivoted by 90° relative to the male member.

Operations and usage of the buckle 52 according to the present embodiment are the same as the foregoing embodiment, and in addition, a relative angle between the male member 14 and the female member 16 can be kept at positions pivoted as shown in FIGS. 13C and D. A force for keeping the positions corresponds to a resistance force, against which the recesses 40*b* of the engaging portions 40 deform the protrusions 22*e* of the engaged portion 22 when being climbed over the protrusions 22*e*, and thus serves as a holding force for positioning. Meanwhile, because the recesses 40*b* are climbed over the protrusions 22*e*, the recesses 40*b* and the protrusions 22*e* are preferably provided with inclines surfaces in a circumferential direction of the shaft portion 22*b*.

The buckle 52 of the present embodiment can obtain the same effects as those of the foregoing embodiments. In particular, the holding force for the relative angle between the male member 14 and the female member 16 can become stronger.

Figure 14A:
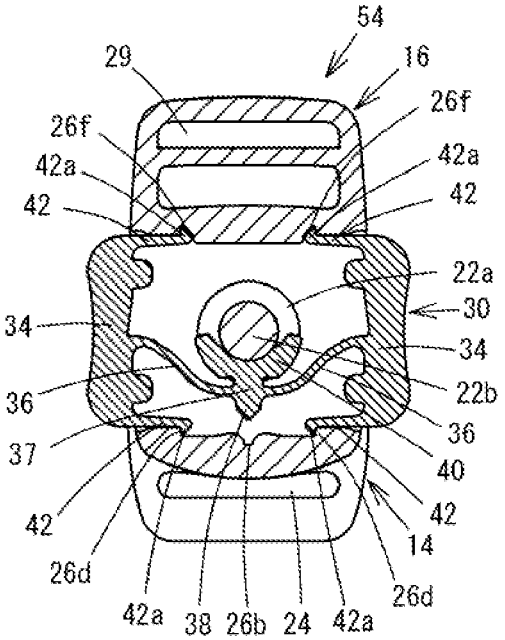
FIG. 14A is a sectional view showing a state where a male member and a female member of a buckle of a fourth embodiment of the invention are engaged with each other, taken along a plane parallel to a paper surface of the front view thereof.
Figure 14B:
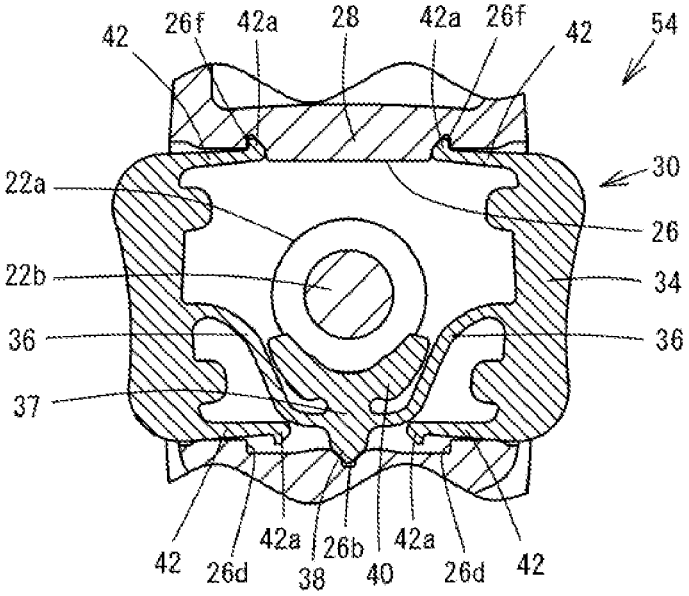
FIG. 14B is a partially enlarged sectional view of a disengaged state thereof.

Next, a fourth embodiment of a buckle according to the preset invention will be described with reference to FIG. 14. Herein, the same members as those of the foregoing embodiments are designated by the same reference numerals, and the descriptions thereof will be omitted. The buckle 54 of the present embodiment is configures so that only one pair of elastic body portions 36 are provided to be formed on a pressing elastic member 30 of a female member 16 and one engaging portion 40 are engaged with an engaged portion 22 of a male member 14. When a pair of pressing portions 34 of the pressing elastic member 30 are pressed to approach to each other, among locking claw pieces 42, locking claw pieces 42 arranged on a side, on which the engaging portion 40 is not provided, are held in notch-shaped positioning portions 26*f* formed in an inner surface of one side wall in a receiving space 26 of a receiving main body 28 and thus are not moved in the pressing direction, so that the pressing portions 34 can be respectively swung about the positioning portions 26*f*. A pair of locking claw pieces 42 on a side, on which the engaging portion 40 is provided, are provided to be locked on positioning portions 26*d* formed on an inner surface of the other side wall in the receiving space 26 of the receiving main body 28 and thus to be moved in the pressing direction, so that sides of the pressing portions 34 on which the engaging portion 40 is located are moved to approach to each other by a pressing operation of the pressing portions 34.

Operations and usage of the buckle 54 of the present embodiment are the same as those of the foregoing embodiment and thus can obtain the same effects. In particular, one engaging portion 40 is provided and manufacturing costs can be inhibited.

Figure 15:
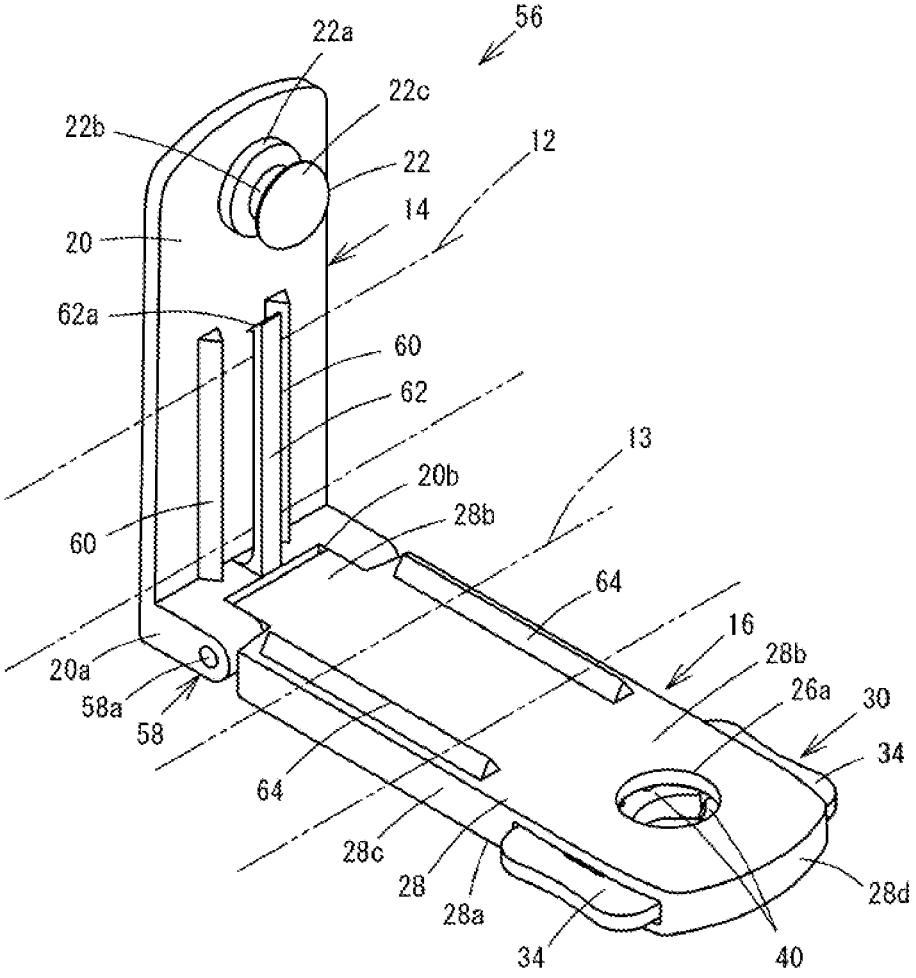
FIG. 15 is a perspective view showing a disconnected state of a buckle of a fifth embodiment of the invention.

Next, a fifth embodiment of a buckle according to the preset invention will be described with reference to FIG. 15. Herein, the same members as those of the foregoing embodiments are designated by the same reference numerals, and the descriptions thereof will be omitted. The buckle 56 of the present embodiment is configured so that a male member 14 and a female member 16 are pivotally connected to each other via a hinge 58.

On end portion of a main body portion 20 of the male member 14, a hinge portion 20*a* is provided to be bent in an L-shaped, and a pivot shaft 58*a* is inserted therethrough. On the middle portion of the hinge portion 20*a*, a recess 20*b* is formed and a protrusion 28*b* formed on an end portion of a receiving main body 28 of the female member 16 is fitted therein. The pivot shaft 58*a* is also inserted through the protrusion 28*b*.

On the inner side of the male member 14, on which an engaged portion 22 is formed, two parallel ridges 60 are formed to extend from the hinge portion 20*a* toward the engaged portion 22. In addition, a rod-shaped insertion guide 62 is provided to extend in parallel to the ridges 60 while being slightly spaced from the ridges 60 in a protruding direction thereof. The insertion guide 62 has a base end portion integrally connected with the hinge portion 20*a* and thus extends in a cantilever beam shape. The insertion guide 62 is an attaching portion intended to be attached to a band body 12 by inserting the band body 12 therethrough. A projection 62*a* protruding in a direction toward the ridges 62 is formed on a leading end portion of the insertion guide 62.

On a rear portion 28*b* of the receiving main body 28 of the female member 16, which faces the male member 14, ridges 64 constituting an attaching portion of the female member 16 are integrally formed to be positioned on the outside of the ridges 60 of the male member 14 and to be provided in parallel to each other. The ridges 64 are provided between the hinge 58 and an opening portion 26*a* of the receiving main body 28 of the female member 16.

The buckle 56 of the present embodiment is configured so that the male member 14 and the female member 16 can be opened and closed via the hinge 58. Therefore, the band body 12 provided on one member to be connected is inserted between the ridges 60 and the insertion guide 62 of the male member 14, and a band body 13 provided on the other member to be connected is arranged on the ridges 64 of the female member 16. Then, the male member 14 and the female member 16 are closed so that the engaged portion 22 is inserted into the opening portion 26*a* of the female member 16. A connecting operation at this time is the same as those of the foregoing embodiments. In this way, two band bodies 12 and 13 are kept overlapped with each other by the male member 14 and the female member 16, and thus the members respectively connected to the band bodies 12 and 13 are connected together.

According to the buckle 56 of the present embodiment, configurations of a pressing elastic member 30 can be formed by an integral member like the foregoing embodiments, thereby providing a buckle having the reduced number of components and a good opening and closing ability for a connecting operation.

Figure 16:
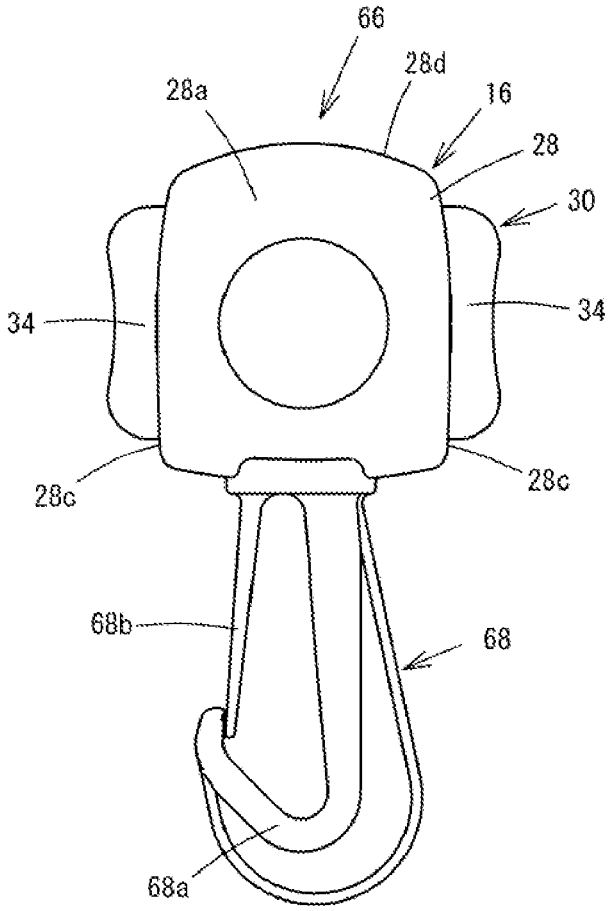
FIG. 16 is a front view showing a buckle of a sixth embodiment of the invention.
Figure 17A:
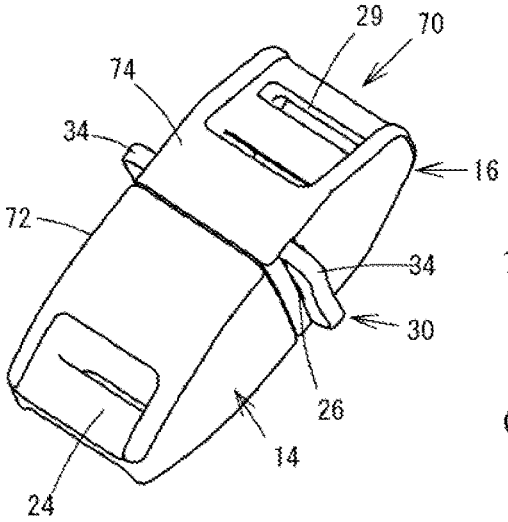
FIG. 17A is a perspective view showing a connected state of a buckle of a seventh embodiment of the invention.
Figure 17B:
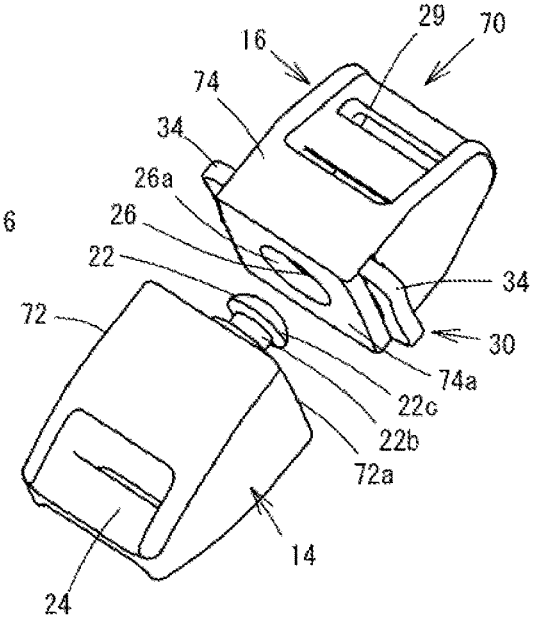
FIG. 17B is a perspective view showing a disconnected state thereof.
Figure 17C:
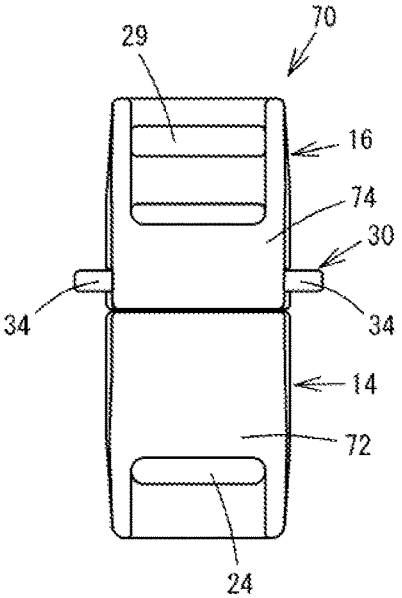
FIG. 17C is a front view showing the connected state.
Figure 17D:
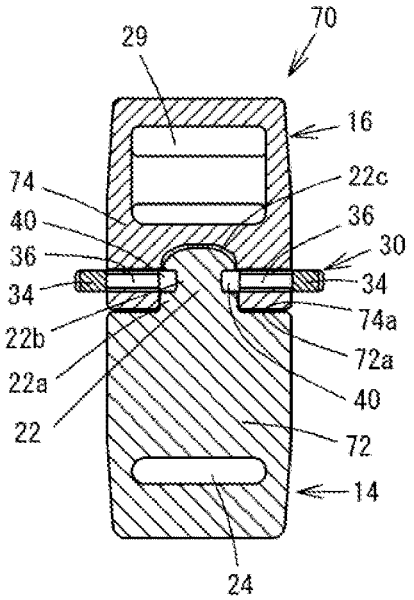
FIG. 17D is a sectional view taken along a plane parallel to a paper surface of the front view of the connected state.

Next, a sixth embodiment of a buckle according to the preset invention will be described with reference to FIG. 16. Herein, the same members as those of the foregoing embodiments are designated by the same reference numerals, and the descriptions thereof will be omitted. The buckle 66 of the present embodiment is configured so that a swivel 68 as an attaching portion is provided on one end side of a female member 16 in a forward and rearward direction of a pressing elastic member 30 and the female member 16 is connected to another member, not shown, via the swivel 68. The swivel 68 is constituted of a hook portion 68*a* and an elastic piece 68*b* for elastically openably closing an opened portion of the hook portion 68*a*.

The swivel 68 is provided to extend toward one end side of a receiving main body 28 of a female member 16 in a forward and rearward direction of a pressing elastic member 30. A male member 14 to be connected with a female member 16 has the same configurations as those of the foregoing embodiments, and thus the male member 14 is configured to be connected and disconnected in a front and back direction of the female member 16 in the same manner as that in each embodiment as described above.

According to the buckle 66 of the present embodiment, a buckle with a swivel, which can obtain the same effects as those of the embodiments as described above and also has a good opening and closing ability for a connecting operation, can be provided.

Next, a seventh embodiment of a buckle according to the preset invention will be described with reference to FIG. 17. Herein, the same members as those of the foregoing embodiments are designated by the same reference numerals, and the descriptions thereof will be omitted. The buckle 70 of the present embodiment 70 is different from each embodiment as described above by 90° in connecting and disconnection operations of a male member 14 and a female member 16. Also, band body attaching holes 24 and 29 of the male member 14 and the female member 16 are formed both end sides of the buckle 70 (a state where the male member 14 and the female member 16 are connected together) in a front and back direction of a pressing elastic member 30. The band body attaching holes 24 and 29 are attaching portions, to which any other members, such as a belt of a child seat or a shoulder belt of a backpack, can be attached.

An engaged portion 22 of the male member 14 is provided on an end surface 72*a* of a main body portion 72 opposite to the band body attaching hole 24 in the front and back direction of the pressing elastic member 30 to protrude from the end surface 72*a* in a direction opposite to the band body attaching hole 24.

An opening portion 26*a* of the female member 16 is formed in an end surface 74*a* of a receiving main body 74 opposite to the band body attaching hole 29 in the front and back direction of the pressing elastic member 30, and the engaged portion 22 of the male member 14 is configured to be inserted from the opening portion 26*a* toward the band body attaching hole 29.

Like each embodiment as described above, the pressing elastic member 30 are inserted into a receiving space 26 of the receiving main body 74 to be parallel to the end surface 74*a*, and pressing portions 34 are operated in a direction of a plane parallel to the end surface 74*a*. In this way, like the embodiments as described above, connecting and disconnecting of the male member 14 and the female member 16 can be performed.

According to the buckle 70 of the present embodiment, a buckle, which can obtain the same effects as those of the embodiments as described above and also has the reduced number of components and a good operability, can be provided. In addition, the engaged portion 22 protruding from the band body attaching hole 24 toward the end surface 72*a* can be connected and disconnected in the protruding direction thereof, and the male member 14 and the female member 16 can be pivoted about an axis along a connecting operation direction (the front and back direction of the pressing elastic member 30) between the band body attaching holes 24 and 29.

Figure 18A:
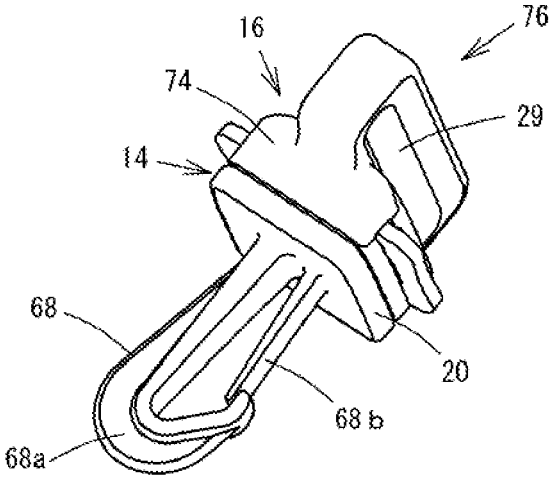
FIG. 18A is a perspective view showing a connected state of a buckle of an eighth embodiment of the invention.
Figure 18B:
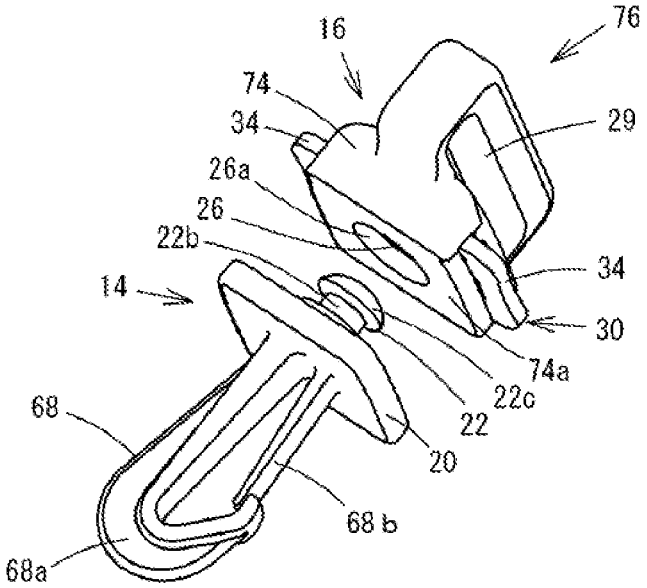
FIG. 18B is a perspective view showing a disconnected state thereof.

Next, an eighth embodiment of a buckle according to the preset invention will be described with reference to FIG. 18. Herein, the same members as those of the foregoing embodiments are designated by the same reference numerals, and the descriptions thereof will be omitted. The buckle 76 of the present embodiment is configured so that a swivel 68 is formed on one end side of a male member 14 in a front and back direction of a pressing elastic member 30. Also, a band body attaching hole 29 is provided on one end side of a female member 16 in the front and back direction 30. The band body attaching hole 29 is an attaching portion, to which any other members, such as a belt of a child seat or a shoulder belt of a backpack, can be attached.

A protruding direction of an engaged portion 22 of the male member 14 is a direction orthogonal to a surface of a main body portion 20, but the swivel 68 is provided to protrude in a direction opposite to the protruding direction of the engaged portion 22 by 180°.

Like the embodiment shown in FIG. 17, the female member 16 is provided with an opening portion 26*a* in an end surface 74*a* of a receiving main body 74 thereof and also provided with the band body attaching hole 29 opposite to the end surface 74*a*.

Like the embodiment shown in FIG. 17, the pressing elastic member 30 are inserted into a receiving space 26 of the receiving main body 74 to be parallel to the end surface 74*a*, and pressing portions 34 are operated in a direction of a plane parallel to the end surface 74*a*, and thus, like the embodiments as described above, connecting and disconnecting of the male member 14 and the female member 16 can be performed.

According to the buckle 76 of the present embodiment, the same effects as those of the embodiments as described above can be obtained.

The buckle of the present invention is not limit to each embodiment as described above, and the composing material thereof may be metal or a composite material of resin and metal, other than resin. The pressing elastic member is sufficient so long as the pressing elastic member is formed in a flat plate shape and each part thereof are integrally formed, and also may be formed by bonding some parts thereof using adhesive, other than integral molding. Shapes of elastic body portions, pressing portions or engaging portions may be appropriately set. Also, the pressing elastic member may have the same shape on front and back sides thereof, and in this case, it is not necessary to consider the front and back thereof upon assembling, thereby facilitating assembling thereof.

Figure 19:
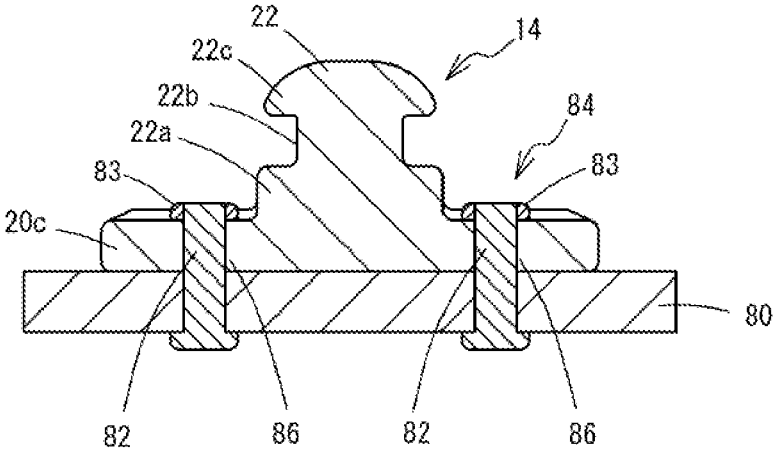
FIG. 19 is a longitudinal sectional view showing another example of an attaching portion of the male member of the buckle according to the invention.

For example, as in the male member 14 shown in FIG. 19, members to which the male member and the female member are to be connected, may be a member 80, such as a sheet-shaped member or one of any other members to be connected together, other than the band body 12, and thus an attaching portion 86 thereof may be fixed to the member 80 using fixture members 84 including bolts 82, nuts 83 or any other screw members or grommets. In addition, members to which the male member and the female member are to be connected may be strings or hook portions, or may be members on which the male member or the female member is integrally formed.

Further, a curved direction or bending of the elastic body portions 36 may be configured so that the engaging portions 40 can be moved in any direction oblique to the pressing direction of the pressing portions 34, other than the direction perpendicular thereto, and also a moving direction of the engaging portions 40 may be set to any suitable direction required for disengaging.

DESCRIPTION OF REFERENCE NUMERALS

10 Buckle
12 Band Body
14 Male Member
16 Female Member
20 Main Body Portion
22 Engaged Portion
22*a* Base End Portion
22*b* Shaft Portion
22*c* Leading End Portion
22*d* Protrusion
24, 29 Band Body Attaching Hole
26 Receiving Space
26*a* Opening Portion
26*b* Locking Recess Portion
26*d* Positioning Portion
26*e* Groove Portion
28 Receiving Main Body
30 Pressing Elastic Member
34 Pressing Portion
34*b* Projection
36 Elastic Body Portion
38 Locking Protrusion Portion
40 Engaging Portion
40*a*, 40*b* Recess
42 Locking Claw Piece
42*a* Claw Portion
58 Hinge

The invention claimed is:

1. A buckle comprising a male member and a female member capable of being connected to and disconnected from each other, each provided with an attaching portion to be attached to another member, wherein the male member is formed with an engaged portion protruding from a main body portion which is provided with the attaching portion, wherein the female member is formed with a pressing elastic member provided with an engaging portion which is configured to be engaged with the engaged portion, and a receiving main body formed with a receiving space for receiving the pressing elastic member, wherein the receiving main body is formed with an opening portion communicated with the receiving space and configured to insert the engaged portion therethrough, wherein the pressing elastic member is integrally provided with:

a pair of pressing portions protruding from the receiving space of the receiving main body;

a pair of elastic body portions connecting the pair of pressing portions together and elastically supporting the pressing portions to allow the pressing portions to be elastically moved into the receiving main body; and the engaging portion elastically held on the pair of elastic body portions, wherein the pair of elastic body portions and the engaging portion form a continuous connection between the pair of pressing portions, and wherein the engaging portion is provided so as to be movable in a direction substantially perpendicular to a pressing direction of the pair of pressing portions when the pressing portions are moved into the receiving main body.

2. The buckle according to claim 1, wherein the engaged portion is formed in a columnar shape and forms a stepped portion by a shaft portion formed on a middle thereof along a protruding direction and having a relatively small diameter and a leading end portion having a relatively large diameter.

3. The buckle according to claim 2, wherein the engaged portion of the male member is provided with a protrusion at a position thereon to be engaged with the engaging portion, and the engaging portion of the pressing elastic member is formed with a recess against which the protrusion abuts.

4. The buckle according to claim 1, wherein the pressing portions of the pressing elastic member are formed with a pair of locking claw pieces extending from one of the pressing portions toward the other of the pressing portions, wherein leading end portions of the locking claw pieces are provided with claw portions protruding toward inner surfaces of side walls of the receiving space, and wherein positioning portions with which the claw portions are engaged are provided on inner walls of the receiving space of the receiving main body.

5. The buckle according to claim 1, wherein a projection is provided on one surface of the pressing elastic member facing a wall surface of the receiving space and a groove portion in which the projection is slid is formed on one wall surface of the receiving space.

6. The buckle according to claim 1, wherein at least one of the attaching portions provided on the male member and the female member is a band body attaching hole to which a band body can be attached.

7. A buckle comprising a male member and a female member capable of being connected to and disconnected from each other, each provided with an attaching portion to be attached to another member, wherein the male member is formed with an engaged portion protruding from a main body portion which is provided with the attaching portion, wherein the female member is formed with a pressing elastic member provided with an engaging portion which is configured to be engaged with the engaged portion, and a receiving main body formed with a receiving space for receiving the pressing elastic member, wherein the receiving main body is formed with an opening portion communicated with the receiving space and configured to insert the engaged portion therethrough, wherein the pressing elastic member is integrally provided with:

a pair of pressing portions protruding from the receiving space of the receiving main body;

a pair of elastic body portions connecting the pair of pressing portions together and elastically supporting the pressing portions to allow the pressing portions to be elastically moved into the receiving main body; and the engaging portion elastically held on the pair of elastic body portions, wherein the pair of elastic body portions and the engaging portion form a continuous connection between the pair of pressing portions, wherein the engaging portion is provided so as to be movable in a direction intersecting with a pressing direction of the pair of pressing portions when the pressing portions are moved into the receiving main body, and wherein the pair of pressing portions are formed on both end portions of the pressing elastic member, wherein the pressing elastic member is provided with two pair of elastic body portions and a pair of engaging portions, each engaging portion symmetrically provided between the pressing portions so that the engaging portions are positioned so as to sandwich the engaged portion therebetween in a connected state, and wherein each of the engaging portions is connected with one pair of the elastic body portions between the pair of pressing portions.

8. A buckle comprising a male member and a female member capable of being connected to and disconnected from each other, each provided with an attaching portion to be attached to another member, wherein the male member is formed with an engaged portion protruding from a main body portion which is provided with the attaching portion, wherein the female member is formed with a pressing elastic member provided with an engaging portion which is configured to be engaged with the engaged portion, and a receiving main body formed with a receiving space for receiving the pressing elastic member, wherein the receiving main body is formed with an opening portion communicated with the receiving space and configured to insert the engaged portion therethrough, wherein the pressing elastic member is integrally provided with:

a pair of pressing portions protruding from the receiving space of the receiving main body;

a pair of elastic body portions connecting the pair of pressing portions together and elastically supporting the pressing portions to allow the pressing portions to be elastically moved into the receiving main body; and the engaging portion elastically held on the pair of elastic body portions, wherein the pair of elastic body portions and the engaging portion form a continuous connection between the pair of pressing portions, wherein the engaging portion is provided so as to be movable in a direction intersecting with a pressing direction of the pair of pressing portions when the pressing portions are moved into the receiving main body, and wherein the engaging portion of the pressing elastic member has a locking protrusion portion and an inner surface of a side wall of the receiving space of the female member has a locking recess portion, and wherein when pressing operation of the pressing portions is performed, the locking protrusion portion which moves in the direction intersecting with the pressing direction and the locking recess portion are engaged with each other.

* * * * *